US009399340B2

(12) United States Patent
Nishi

(10) Patent No.: US 9,399,340 B2
(45) Date of Patent: Jul. 26, 2016

(54) MEMBER FOR INK RECORDING, INK RECORDING BODY, AND LAMINATED BODY FOR INK RECORDING

(75) Inventor: Taiji Nishi, Tokyo (JP)

(73) Assignee: ADVANTEST CORPORATION, Tokyo (JP)

( * ) Notice: Subject to any disclaimer, the term of this patent is extended or adjusted under 35 U.S.C. 154(b) by 7 days.

(21) Appl. No.: 14/356,066

(22) PCT Filed: Sep. 5, 2012

(86) PCT No.: PCT/JP2012/073242

§ 371 (c)(1),
(2), (4) Date: Apr. 1, 2015

(87) PCT Pub. No.: WO2013/077063

PCT Pub. Date: May 30, 2013

(65) Prior Publication Data

US 2016/0159083 A1 Jun. 9, 2016

(30) Foreign Application Priority Data

Nov. 22, 2011 (JP) ..... 2011-255366

(51) Int. Cl.

| | |
|---|---|
| ***B41J 2/01*** | (2006.01) |
| ***B41J 2/005*** | (2006.01) |
| ***B41M 5/50*** | (2006.01) |
| *B41M 5/52* | (2006.01) |

(52) U.S. Cl.

CPC *B41J 2/01* (2013.01); *B41J 2/0057* (2013.01); *B41M 5/50* (2013.01); *B41M 5/506* (2013.01); *B41M 5/508* (2013.01); *B41M 5/52* (2013.01); *B41M 5/5209* (2013.01)

(58) Field of Classification Search

None

See application file for complete search history.

(56) References Cited

U.S. PATENT DOCUMENTS

| | | | |
|---|---|---|---|
| 5,264,527 | A | 11/1993 | Varshney et al. |
| 5,294,674 | A | 3/1994 | Varshney et al. |
| 5,591,816 | A | 1/1997 | Varshney et al. |
| 5,668,231 | A | 9/1997 | Varshney et al. |
| 6,329,480 | B1 | 12/2001 | Uchiumi et al. |
| 2002/0032290 | A1 | 3/2002 | Uchiumi et al. |
| 2003/0021961 | A1 | 1/2003 | Ylitalo et al. |
| 2003/0191243 | A1 | 10/2003 | Hamada et al. |

(Continued)

FOREIGN PATENT DOCUMENTS

| | | | |
|---|---|---|---|
| JP | 05-507737 | | 11/1993 |
| JP | 11217523 | A * | 8/1999 |

(Continued)

OTHER PUBLICATIONS

Written Opinion of the International Searching Authority for PCT/JP2012/073242, which was mailed on Oct. 16, 2012.

(Continued)

*Primary Examiner* — Lisa M Solomon

(74) *Attorney, Agent, or Firm* — Greenblum & Bernstein, P.L.C.

(57) ABSTRACT

The present invention provides a resin-based ink recorded body having high transparency, high definition, free from bleeding and having a high film strength of an ink. An ink recording member of the present invention includes a substrate containing an acrylic resin and a plant oil derived from a fatty acid having hydroxyl and carboxyl group blended to the acrylic resin, and an ink fixing film composed of a hydrophilic resin and provided on at least one main face of the substrate. An ink printed pattern is provided on the film.

15 Claims, 11 Drawing Sheets

(56) References Cited

U.S. PATENT DOCUMENTS

| | | | |
|---|---|---|---|
| 2005/0181150 | A1 | 8/2005 | Aono |
| 2007/0298195 | A1 | 12/2007 | Nishimura et al. |
| 2011/0189409 | A1 | 8/2011 | Nishimura et al. |

FOREIGN PATENT DOCUMENTS

| | | |
|---|---|---|
| JP | 11-335432 | 12/1999 |
| JP | 2002-326448 | 11/2002 |
| JP | 2003-277574 | 10/2003 |
| JP | 2004-532144 | 10/2004 |
| JP | 2005-225179 | 8/2005 |
| JP | 2006-56100 | 3/2006 |
| JP | 2006-131797 | 5/2006 |
| JP | 2009-141808 | 6/2009 |
| JP | 2011-168055 | 9/2011 |
| JP | 2012-90587 | 5/2012 |
| WO | 02/085638 | 10/2002 |

OTHER PUBLICATIONS

English translation of International Search Report for PCT/JP2012/073242, which was mailed on Oct. 16, 2012.

* cited by examiner

MEMBER FOR INK RECORDING, INK RECORDING BODY, AND LAMINATED BODY FOR INK RECORDING

TECHNICAL FIELD

The present invention relates to an ink recording member having high transparency and high definition, free from bleeding, and having excellent adhesion between the ink (a film for fixing the ink) and a resin substrate. The present invention provides ink recording members suitable for various industrial applications. Further, in addition to this, optional patterns can be recorded on the ink recording member using, for example, a commercial ink jet printer and personal computer, and the ink recording member can be easily fixed on an instrument, machine, glass, container, display or the like to improve the design.

BACKGROUND ARTS

In a substrate or film for recording ink using an ink jet printer system, it is demanded a large reception amount of the ink and a high adhesive strength between an ink fixing film and the substrate as the definition of the ink jet printer is improved. Further, a high transparency is required for the ink recorded body.

It is proposed a method of printing ink on a image-fixing material having a porous layer of an average micro pore size of 0.05 to 100 μm on the uppermost layer of a thermoplastic resin and of then flattening the printed face (Patent document 1: Japanese Patent Publication No. 2005-225,179A). It is further proposed an ink jet recording body having an ink receiving layer (hydrophilic resin) having a melting point of 40 to 55° C. on a substrate (Patent document 2: Japanese Patent Publication No. 2011-168,055A).

However, according to the porous layer having an average micro pore size of 0.05 to 100 μm, for example, although it becomes possible to receive the ink, light is scattered within the pores to lower the transparency, which is problematic. Further, the step of heating the printed image-reception layer and passing it through a roll limits applicable uses. For example, its family use is impossible.

As a representative of a material having a high transparency, acrylic resin is known. An acrylic resin has a low refractive index of 1.490 and a low reflectivity on the material surface to provide high and deep transparency. Among them, acrylic block copolymer is thermoplastic and excellent in its molding property and handleability. Further, since the block copolymer is flexible, elastic, and excellent in its mechanical properties and transparency, its application has been tried in various fields (Patent document 3: Japanese Patent Publication No. H05-507,737A, Patent document 4: Japanese Patent Publication No. 1999-335,432A, Patent document 5: Japanese Patent Publication No. 2003-277,574A).

PRIOR ARTS (Patent document 1) Japanese Patent Publication No. 2005-225,179A)

(Patent document 2) Japanese Patent Publication No. 2011-168,055A)

(Patent document 3) Japanese Patent Publication No. H05-507,737A)

(Patent document 4) Japanese Patent Publication No. 1999-335,432A)

(Patent document 5): Japanese Patent Publication No. 2003-277, 574A)

(Patent document 6) Japanese Patent Publication No. 2009-141,808A (Patent document 7) Japanese Patent Publication No. 2012-090,587A

SUMMARY OF THE INVENTION

However, since the acrylic resin or acrylic block copolymer is hydrophobic, in the case that it is tried to draw water soluble pigment ink or dye ink thereon, such water soluble pigment ink or dye ink is repelled so that it is impossible to draw desired drawings. Such water soluble pigment ink and dye ink are not dried and thus inferior in handleability.

Further, In the case that it is tried to cover a substrate or film made of the acrylic resin or acrylic block copolymer with a hydrophilic resin receiving the ink, the acrylic resin or acrylic block copolymer repels the hydrophilic resin and it is difficult to accomplish the covering step. As the film thickness of the coverage of the hydrophilic resin is made larger, although the coverage of the substrate or film becomes possible, the adhesion of it with the acrylic resin or acrylic block copolymer forming the substrate is extremely low for practical use.

An object of the present invention is to provide a resin-based ink recorded body having high transparency, high definition, free from bleeding and excellent in film strength of ink.

The present invention provides an ink recording member comprising:

a substrate comprising an acrylic resin and a plant oil derived from a fatty acid having hydroxyl group and carboxyl group, said plant oil being blended to said acrylic resin; and an ink fixing film comprising a hydrophilic resin and provided on at least one main face of said substrate.

The present invention further provides an ink recorded body comprising the ink recording member and a printed pattern of an ink fixed on the ink fixing film.

The present invention further provides a laminated ink recorded body comprising a plurality of the ink recorded bodies, wherein the ink recorded bodies are laminated.

According to the present invention, it is possible to provide an ink recorded body having high transparency and high definition, free from bleeding and excellent in film strength of the ink. Therefore, according to the present invention, it is possible to provide ink recording members suitable for various kinds of industrial applications. It is further possible to record optional patterns on the ink recording member using, for example, a commercial ink jet printer and personal computer, and the ink recording member can be easily fixed on instruments, machines, glass, containers, displays or the like to improve the design.

Further, according to the present invention, it is possible to superimpose a plurality of patterns of printed ink at a high definition, by laminating the ink recorded bodies as described above.

Therefore, the present invention provides a market of new products and its industrial contribution is considerable.

EMBODIMENTS OF THE INVENTION

Figure 1:
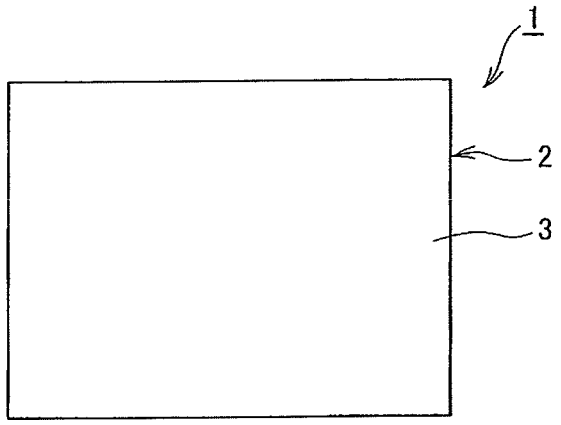
FIG. 1(*a*) is a plan view showing an ink recording member 1 according to an embodiment, FIG. 1(*b*) is a view showing a back side of the ink recording member 1, and FIG. 1(*c*) is a diagram schematically showing the ink recording member 1.
Figure 1:
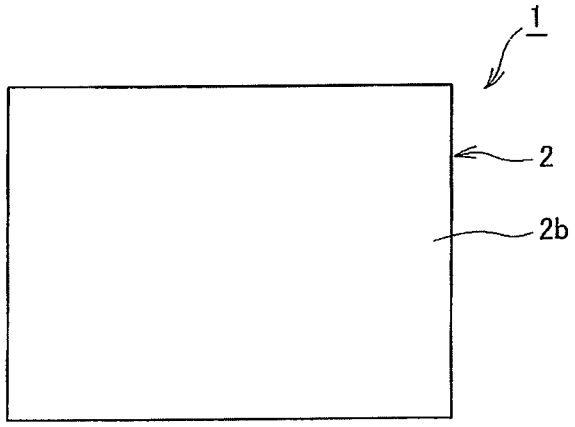
Figure 1:
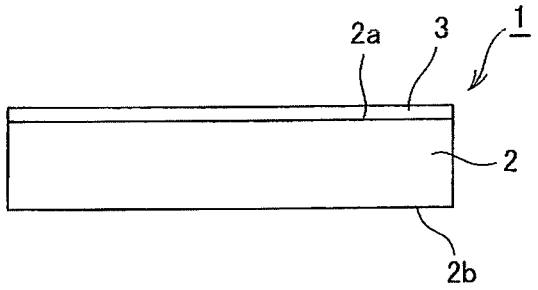

Embodiments of the present invention will be described referring to the drawings.

The ink recording member of the present invention includes a substrate including an acrylic resin and a plant oil derived from a fatty acid having hydroxyl group and carboxyl group blended to the acrylic resin, and an ink fixing film of a hydrophilic resin and provided on at least one main face of the substrate. It is thus possible to provide an ink recording member having high transparency and high definition, free from bleeding and excellent in an ink (ink fixing film) and the substrate.

Figure 2:
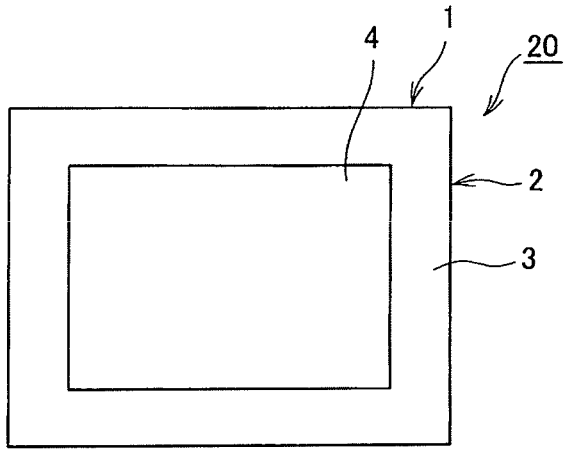
FIG. 2(*a*) is a plan view showing an ink recorded body 20 according to an embodiment, FIG. 2(*b*) is a view showing a back side of the ink recorded body 20, and FIG. 2(*c*) is a diagram showing schematically showing the ink recorded body 20.
Figure 2:
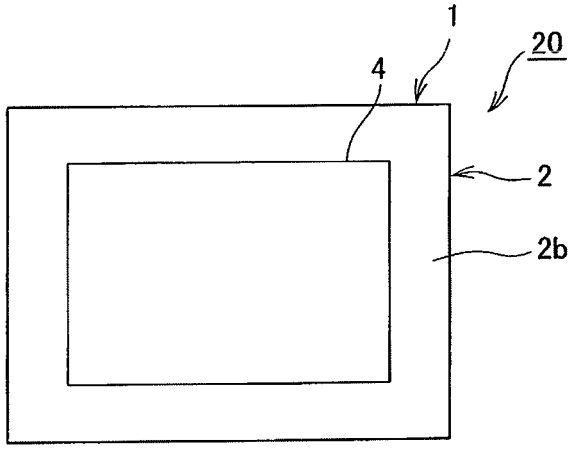
Figure 2:
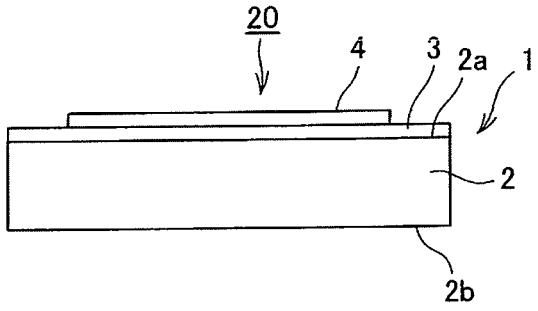

For example, according to an ink recording member 1 of FIG. 1, a film 3 of a hydrophilic resin is formed on one main face 2*a* of a substrate 2. The ink recording member may be sold as a product. Alternatively, as shown in FIG. 2, a pattern 4 of printed ink may be further provided on the film 3 to provide an ink recorded body 20 with the predetermined printed pattern fixed thereon. Besides, details of the printed pattern 4 are not particularly limited and thus omitted in FIGS. 1 and 2.

Figure 3A:
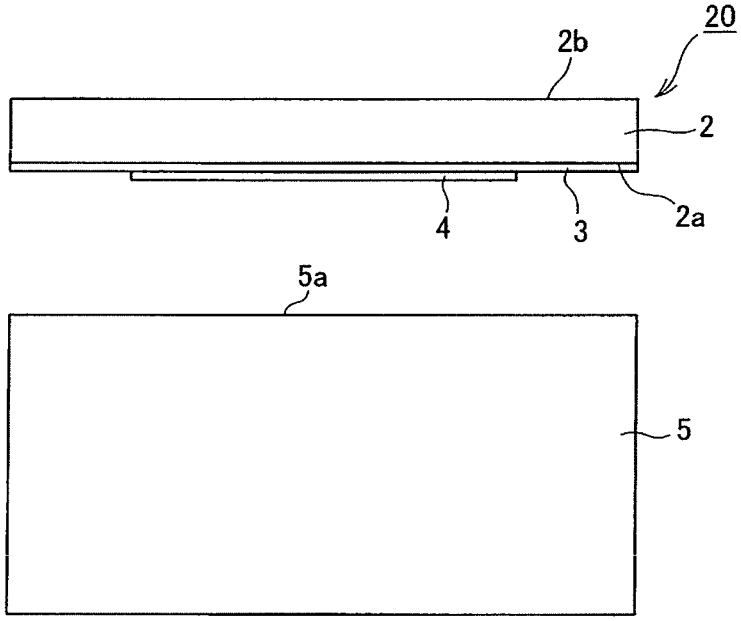
FIG. 3(*a*) is a diagram schematically showing the state before the ink recorded body 20 is adhered to a supporting body 5, and FIG. 3(*b*) is a diagram schematically showing an ink recorded body 30 with the supporting body 5.
Figure 3:
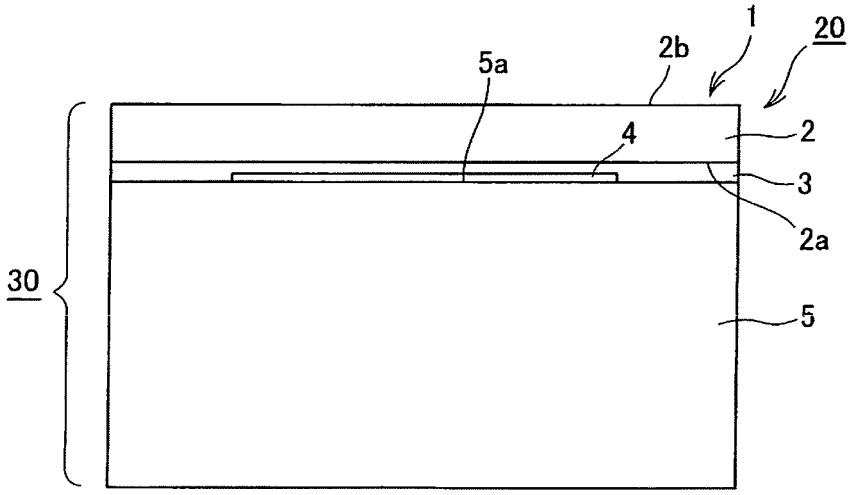
Figure 4:
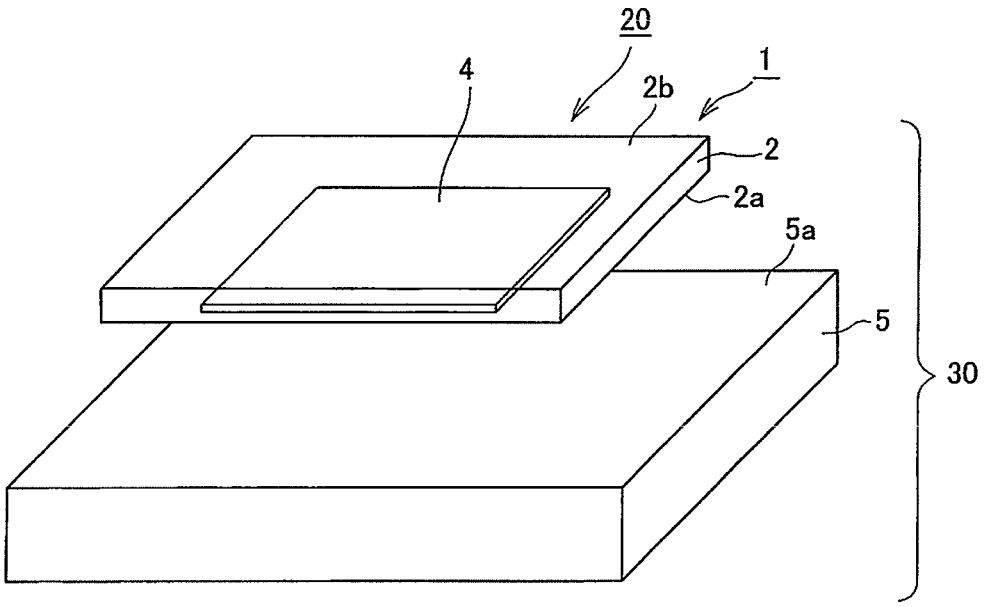
FIG. 4 is a broken perspective view schematically showing the ink recorded body 30.

As shown in FIGS. 3 and 4, by adhering and integrating the substrate 2 of the ink recorded body 20 and the supporting body 5, it is further possible to constitute an ink recorded body 30 further having the supporting body. Here, the film 3 and printed pattern 4 are sandwiched between the substrate 2 and an adhesive face 5*a* of the supporting body 5. According to the present example, the other main face 2*b* of the substrate 2 is exposed.

(Material of Substrate)

The material of the substrate is provided by blending a plant oil derived from a fatty acid having hydroxyl group and carboxyl group to an acrylic resin. Besides, the supporting body may also preferably be provided by blending a plant oil derived from a fatty acid having hydroxyl group and carboxyl group to an acrylic resin. The materials of the substrate and supporting body may be the same or different from each other.

(Acrylic Resin)

An acrylic resin has high transparency and high weather resistance, and its color change and deterioration due to sunlight are small, so that it has been utilized in various fields such as an window glass of an airplane, optical fiber used for optical communication or the like, illumination appliances, billboards or the like. It is the most suitable material as the material for ink recording member having transparency.

Specific examples of the acrylic resin includes polymers of a monomer such as methacrylic acid, acrylic acid, methyl methacrylate, methyl acrylate, ethyl methacrylate, ethyl acrylate, n-propyl methacrylate, n-propyl acrylate, n-butyl methacrylate, n-butyl acrylate, t-butyl methacrylate, t-butyl acrylate, n-hexyl methacrylate, n-hexyl acrylate, cyclohexyl methacrylate, cyclohexyl acrylate, chloromethyl methacrylate, chloromethyl acrylate, 2-chloroethyl methacrylate, 2-chloroethyl acrylate, 2-hydroxyethyl methacrylate, 2-hydroxyethyl acrylate, 3-hydroxypropyl methacrylate, 3-hydroxypropyl acrylate, 2,3,4,5,6-pentahydroxyhexyl methacrylate, 2,3,4,5,6-pentahydroxyhexyl acrylate, 2,3,4,5-tatrahydroxypentyl methacrylate, 2,3,4,5-tetrahydroxypentyl acrylate or the like, or a copolymer of the monomers as listed above.

As to the acrylic resin, the substrate may be composed of an acrylic block copolymer or mixture of the acrylic resin with the acrylic block copolymer, so that it is possible to obtain flexibility and self-adhesiveness in addition to the transparency and thereby to enlarge the applicability of the ink recorded body.

As to the acrylic block copolymer, it may be listed polymethyl methacrylate-polybutyl acrylate (MA), polymethyl methacrylate-polybutyl acrylate-polymethyl methacrylate (MAM) or the like, for example.

A copolymer includes four kinds of structures of random copolymer (-ABBABBBAAABA-), alternating copolymer (-ABABABABABAB-), periodic copolymer (-AAABBAAABBAAA-) and block copolymer (-AAAAAABBBBBB-). Further, it is known a copolymer called graft copolymer as one of the block copolymer, having branched structure including a high molecular chain forming a trunk and branched and heterogeneous high molecular chains bonded to the trunk.

The block copolymer is produced by living polymerization. Among polymerization reactions, living polymerization means polymerization which does not accompany sub reactions such as transfer and terminating reactions during chain polymerization reaction. As to the characteristics of the living polymerization, since the growing terminals of the polymer is always active for the polymerization (living), the polymerization is further proceeded by adding additional amount of the monomer after the monomer is once completely consumed, and it can be obtained the polymer chains having an uniform length, and so on.

The acrylic block copolymer includes a di-block copolymer of AB type composed of polymethyl methacrylate (A, hard) and polybutyl acrylate (B, soft), an ABA type tri-block copolymer composed of polymethyl methacrylate (A, hard), polybutyl acrylate (B, soft) and polymethyl methacrylate (A, hard), or the like, for example.

By the acrylic block copolymer, even the polymer refractive indices of the blocks are different from each other, the length of the chains are uniform to provide dispersion structure at nano-order. It is thus possible to maintain high transparency.

By elevating the ratio of rubber component of polybutyl acrylate, the flexibility can be improved. The ratio of components A and B may preferably be selected depending on a target application.

Further, since the acrylic block copolymer is flexible, it is possible to improve the adhesive strength of the hydrophilic resin forming the ink fixing film and the substrate.

When the substrate is covered by the hydrophilic resin, the hydrophilic resin is affined with hydroxyl groups present not only on a surface of the substrate but also hydroxyl groups inside of the substrate by infiltrating into the inside of the substrate. It is thus possible to obtain physical anchoring effect in addition to chemical adhesive force.

As to the blending ratio of the acrylic resin and acrylic block copolymer in the mixture, a ratio of 5/95 wt. % to 95/5 wt. % is preferred, and a ratio of 20/80 wt. % to 80/20 wt. % is more preferred, on the viewpoint of obtaining both of the moldability and handleability, As to the blending ratio in the acrylic block copolymer itself, on the viewpoint of obtaining both of the moldability and handleability, a ratio of 2/96/2 wt. % to 45/10/45 wt. % is preferred, and a ratio of 5/90/5 wt. % to 25/50/25 wt. % is more preferred, in the case of the ABA type block copolymer composed of polymethyl methacrylate (A, hard)-polybutyl acrylate (B, soft)-polymethyl methacrylate (A, hard).

(Plant Oil)

By mixing the plant oil derived from a fatty acid having hydroxyl group and carboxyl group to the acrylic resin, it becomes possible to attain, for the first time, both of transparency of the ink recorded body and high adhesive strength of the ink (ink fixing film) and substrate.

The plant oil means oil derived from a plant, including purified plant oil and a derivative obtained by chemically treating a plant oil, for example by hydrogenation or the like. Further, the plant oil may be a mixture. Although the purity of the plant oil is not particularly limited, the purity may preferably be 80 weight percent or higher and more preferably be 90 weight percent or higher.

Since the fatty acid constituting the plant oil used in the present invention contains carboxyl group, it is mutually soluble with ester (compound having carboxyl group) of the acrylic resin. It is thus possible to realize dispersion of the acrylic resin at nano-order and to maintain high transparency after it is mixed with the acrylic resin.

Further, since the fatty acid includes hydrogen group, it is possible to provide a hydrophilic group inside of and on a surface of the acrylic resin and to provide chemical affinity at an interface of the substrate and the hydrophilic resin forming the ink fixing film. It is thus possible to considerably improve adhesion to the substrate.

A compound containing hydrogen group reacting with fatty acid includes ethylene glycol, propylene glycol, diethylene glycol, dipropylene glycol, glycerin, polyglycerin or the like.

Specific example of the plant oil includes caster oil, a derivative of castor oil such as hydrogenated castor oil, or the mixture thereof.

Castor oil contains an ester of fatty acid (ricinoleic acid) and glycerin as its main component and can be used for performing many kinds of chemical reactions by utilizing its hydroxyl group (OH group), double bond and ester bond. The thus obtained products are applied in various kinds of applications such as paint, plastic, rubber, building material, metal and machinery industries. Further, castor oil is a viscous and non-drying oil of light yellow, and has the characteristic that it is soluble most of organic solvents excluding aliphatic hydrocarbon solvent. The purity of castor oil is preferably 90 weight percent or higher.

Besides, in the Patent document 6 (Japanese Patent Publication No. 2009-141808A, it is described that castor oil is added to an acrylic monomer to solidify (polymerize) it to make the resin softer for a damping material of a speaker. It is not related to a base of an ink recording body.

(Blending Ratio and Method)

The Blending Ratio of the Plant Oil Derived from a Fatty Acid having hydroxyl group and carboxyl group with respect to the acrylic resin may preferably be 0.5 to 50 weight percent and more preferably be 1.0 to 25 weight percent, provided that 100 weight percent is assigned to the total weight of the blend, on the viewpoint of maintaining transparency and preventing bleeding out of the castor oil.

As the method of mixing the acrylic resin and plant oil in the case that the resin is plasticized by heat to obtain the substrate, for example, it may be listed the method of mixing the acrylic resin and plant oil by means of a blender in advance, and the method of preparing a blend having a high content of the plant oil and of blending it with the acrylic resin during the molding.

As the method of molding the substrate and supporting body, it may be listed injection molding, press molding, extrusion molding, roll molding, monomer cast molding, solvent cast molding or the like, for example.

The mixture of the acrylic block copolymer and plant oil can be easily obtained by cast molding of dissolving the acrylic block copolymer and plant oil in an organic solvent such as acetone and of evaporating the organic solvent, for example. Since the acrylic block copolymer and the plant oil of the fatty acid having hydroxyl group and carboxyl group are mutually dissolved owing to the respective chemical structures, the transparent substrate can be obtained.

As the acrylic block copolymer has chains whose lengths are uniform, even in the case that the refractive indices of the blocks are different from each other, it may be provided a phase separation structure at the order of several tens nm. It is thus possible to obtain the substrate of preventing the refraction of light having a visible light wavelength of 400 to 650 nm.

As to preferred optical properties of the substrate and supporting body, the total light transmittance (at a thickness of 0.5 mm) and haze value (at a thickness of 0.5 mm) may preferably be 70 percent or higher and 30 percent or lower, respectively, and more preferably be 80 percent or higher and 20 percent or lower, respectively.

The substrate and supporting body has stable self-adhesiveness over a long time period.

As the ratio of the soft (liquid like) segment in the block copolymer is larger, the soft component of polybutyl acrylate is present on the surface at nano-order to exhibit self-adhesiveness. Since a plasticizer is not used, the self-adhesiveness is not lowered in the adhesiveness over time, for example over a time period of 6 months or longer, so that it is possible to assure the product quality.

Such self-adhesiveness alleviates the need of an adhesive and prevents the inclusion of bubbles during the step of laminating the plate shaped substrates so that the production costs can be reduced. The adhesiveness is also effective for a thermoplastic material, glass, silicon wafer, print wiring board, elastomer, engineering plastic or the like to contribute to the mounting of the ink recording member.

Further, as the molecular weight of the block copolymer is uniform and thus has a tear strength larger than that of a prior elastomer, it is possible to prevent problems such as the fracture or the like during drilling process. As the molecular weight is uniform, the copolymer does not contain a low molecular weight compound, which is possibly toxic, and can be used for a biological test.

Although the thickness of the substrate is not particularly limited, it may preferably be 0.02 mm to 50 mm and more preferably be 0.1 to 20 mm.

As to the method of obtaining the substrate and supporting body, it may be listed injection molding, press molding, extrusion molding, monomer cast molding, solvent cast molding or the like, for example.

(Ink Fixing Film of Hydrophilic Resin)

By forming the film of the hydrophilic resin on at least one main face of the substrate, it is possible to impregnate and fix the target ink. The ink is dried by the impregnation into the hydrophilic resin and fixed on the substrate.

On the viewpoint of facilitating the impregnation of the ink, the contact angle of the hydrophilic resin with respect to water may preferably be 3 to 60° and more preferably be 10 to 40°.

The hydrophilic resin includes, for example, one of polyacrylic acid, polyacrylate, polyvinyl alcohol, polyacrylamide, polyethylene glycol, carboxymethyl cellulose and polyvinyl pyrrolidone having one or more of carboxyl group, hydroxyl group, sulfone group, amide group and ether bond, and the copolymers or mixtures thereof.

The method of covering the hydrophilic resin includes treatment with a drug, treatment with a solvent, treatment with a coupling agent, monomer coating, polymer coating, vapor treatment, surface grafting, treatment by irradiating ultraviolet light, plasma contact treatment, plasma jet treatment, plasma polymerization treatment, ion beam treatment, dipping method, spin coating, excimer UV treatment or the like.

As the film thickness of the hydrophilic resin covering the substrate is too thin, the impregnation of the ink is reduced, and as the film thickness is too large, it may be a cause of the reduction of water resistance. The lower limit of the film thickness of the hydrophilic resin may preferably be 0.1 micron or larger and more preferably be 1 micron or larger, and still further preferably be 10 microns or larger. Further, the upper limit of the film thickness of the hydrophilic resin may preferably be 1000 microns or smaller, more preferably be 100 microns or smaller and still further preferably be 50 microns or smaller.

The technique of reforming the wettability of the acrylic resin is categorized into chemical treatment and physical treatment techniques. The chemical treatment technique includes treatment with a drug, treatment with a solvent, treatment with a coupling agent, monomer coating, polymer coating, vapor treatment, surface grafting, electrochemical treatment or the like. The physical treatment technique includes treatment by irradiating ultraviolet light, plasma contact treatment, plasma jet treatment, plasma polymerization treatment, ion beam treatment, mechanical treatment or the like.

(Water Soluble Resin Film)

The hydrophilic resin is particularly preferably a water soluble resin. By covering the plate-shaped substrate made of a thermoplastic resin or mixture of the thermoplastic resin and oil with the water soluble resin, the productivity can be considerably improved.

Since an organic solvent is not needed for dissolving the water soluble resin, it is possible to cover any of the thermoplastic resins. It can be easily covered without the need of a large-scale production system.

Since castor oil is blended according to the invention, it exhibits affinity with hydroxyl group (OH group) of the hydrophilic resin, so that the concentration of the water soluble resin dissolved in water can be made lower. Since the hydrophilic film having a strong adhesion force to the substrate can be formed as a thin film, it is possible to improve the water resistance which has been a defect of the water soluble resin. In the case that greater water resistance is demanded, for example, in the case that polyvinyl alcohol is used, it may be selected that of the grade having a saponification degree of 90 percent or higher and a molecular weight of 1000 or larger.

The water soluble resin includes, for example, vinyl acetate resin (trade name, EXCEVAL, POVAL), polyvinyl alcohol, hydroxyl alkyl cellulose, polyvinyl pyrrolidone, polyvinyl caprolactam, trade name "Lipidure-PMB" supplied by NOF corporation, (copolymer of MPC polymer having phopholipid polar group) and butyl acetate or the like.

The method of covering the substrate with the water soluble resin includes, for example, spin coating, dipping, mist spraying or the like.

The concentration of the water soluble resin dissolved in water may preferably be 0.1 to 20 weight percent and more preferably be 1 to 10 weight percent. It may be selected depending on the wettability of the substrate to be covered and the covering method.

As the film thickness of the water soluble resin covering the substrate is too thin, the impregnation of the ink is reduced, and as the film thickness is too large, it may be a cause of the reduction of water resistance. The lower limit of the film thickness of the water soluble resin may preferably be 0.1 micron or larger and more preferably be 1 micron or larger, and still further preferably be 10 microns or larger. Further, the upper limit of the film thickness of the water soluble resin may preferably be 1000 microns or smaller, more preferably be 100 microns or smaller and still further preferably be 50 microns or smaller.

(Preferred Physical Properties)

In the substrate composed of the mixture of the acrylic resin and the plant oil derived from a fatty acid having hydroxyl group and carboxyl group, the hydroxyl group may be present inside or on the surface of the substrate, so that the adhesive strength between the substrate and the hydrophilic resin forming the ink fixing film can be considerably improved. As a result, in the case that the ink recorded body is adhered onto a curved surface such as a glass container or it is repeatedly adhered and peeled off, it is possible to prevent the peeling of the drawn pattern and to maintain the design, even when the ink recorded body is deformed.

On the viewpoint, the adhesive strength between the substrate and hydrophilic resin may preferably be 0.3 to 10 N and more preferably be 1 to 5 N.

The measurement of dynamic viscoelasticity is an effective means of understanding the characterization of the ink recorded body. As the ratio of the hard segment is larger in the hard and soft segments of the acrylic block copolymer, the storage modulus (E') becomes higher and the flexibility and self-adhesiveness of the ink recorded body tend to be lower. As the ratio of the soft segment is larger, the storage modulus (E') becomes lower and the flexibility and self-adhesiveness of the ink recorded body tend to be higher.

On the viewpoint of exhibiting the flexibility and self-adhesiveness as well as of obtaining handleability (not too soft and not too strong adhesive strength) at the same time, the storage modulus (E') at a temperature of 10° C. to 40° C.±3 by dynamic viscoelasticity measurement (tension mode, 11 Hz) may preferably be 10000 Pa to 100 MPa and more preferably be 50000 Pa to 50 MPa.

According to the dynamic viscoelasticity measurement, in addition to the storage modulus (E'), it may be measured the peak temperature of tan δ of the soft (rubber like) segment corresponding to the transition from glass state to rubber state, so that the flexibility and self-adhesiveness of the ink recorded body can be evaluated.

On the viewpoint of exhibiting the flexibility and self-adhesiveness together with the handleability (not too soft and not too strong adhesive force) at the same time, the peak temperature of tan δ of the soft segment (soft component) corresponding to the transition from glass state to rubber state may preferably be −80 to +50° C. and more preferably be −50° to +20° C., in dynamic viscoelasticity measurement (tension mode, 11 Hz).

As the inventive ink recording member has the self-adhesiveness, it is possible to adhere it onto a thermoplastic material, glass, silicon wafer, print wiring board, elastomer, silicon, engineering plastic or the like, for example. Further, it is the characteristic that it can be adhered onto a curved surface or embossed surface as well as a flat surface.

In the case that the hardness of the substrate is too large, it becomes difficult to adhere it onto the curved or embossed surfaces. The shore hardness (ASTM D 2240) in a temperature range of 10 to 40° C. may preferably be in a range of 10 to 90 and more preferably be in a range of 20 to 70.

The self-adhesiveness of the substrate may preferably be in a range of 0.5 to 10N and more preferably in a range of 1 to 0.5N, on the viewpoint of alleviating the necessity of an adhesive and of enabling the adhesion repeatedly.

As to the optical properties of the substrate, the total transmittance (at a thickness of 0.5 mm) and haze value (at a thickness of 0.5 mm) may preferably be 70 percent or higher and 30 present or lower, respectively, and more preferably be 80 percent or higher and 20 percent or lower, respectively, on the viewpoint of maintaining the transparency and of enabling the covering of the hydrophilic resin providing the ink fixing film.

(Printed Pattern)

As the kind of the ink, it may be listed an aqueous or solvent dye ink, pigment ink, gel, cake ink or the like.

According to the ink recorded body of the present invention, it can be used a water soluble pigment ink and/or a water soluble dye ink, a commercial ink jet printer can be used to print drawing patterns such as photographs, pictures, figures or the like in full color mode.

The method of covering the hydrophilic resin with the ink includes the method of direct printing an ink jet printer, direct drawing by means of a pen or brush, printing using a masking tool such as stainless steel including openings or the like, for example.

For example, in the case that a dye ink or pigment ink used for an ink jet printer is applied, it is possible to print patterns of optional densities and shapes at an extremely fine definition by specifying them by means of a personal computer. The minimum unit of the discharge amount in an ink jet printer is 1 pico-liter, so that the printing at the minimum unit of 30 microns can be easily and rapidly made.

(Laminated Ink Recorded Body)

By preparing a laminated structure using the inventive ink recorded body, it becomes possible to attain the function which cannot be expressed using a single layer of the substrate or film. For example, by printing a structure and its background on separate substrates, respectively, three-dimensional drawing can be realized. In the case that a photoluminescent pigment, light scattering pigment or the like is drawn for providing a laminated structure, it is possible to realize the increase of the light amount, which cannot be attained by a single layer product, and to provide a beacon or the like with improved visibility.

Figure 5:
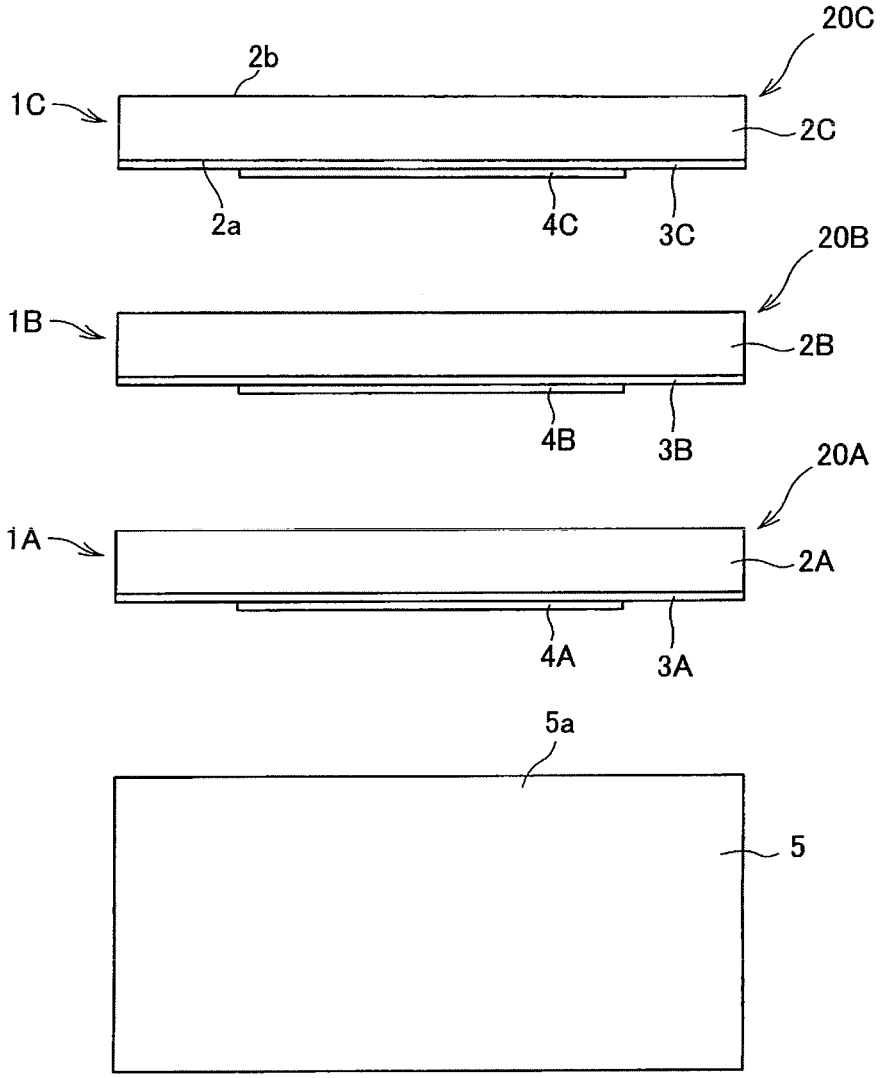
FIG. 5 is a broken view schematically showing the supporting body 5 and ink recorded bodies 20A to 20C.
Figure 6:
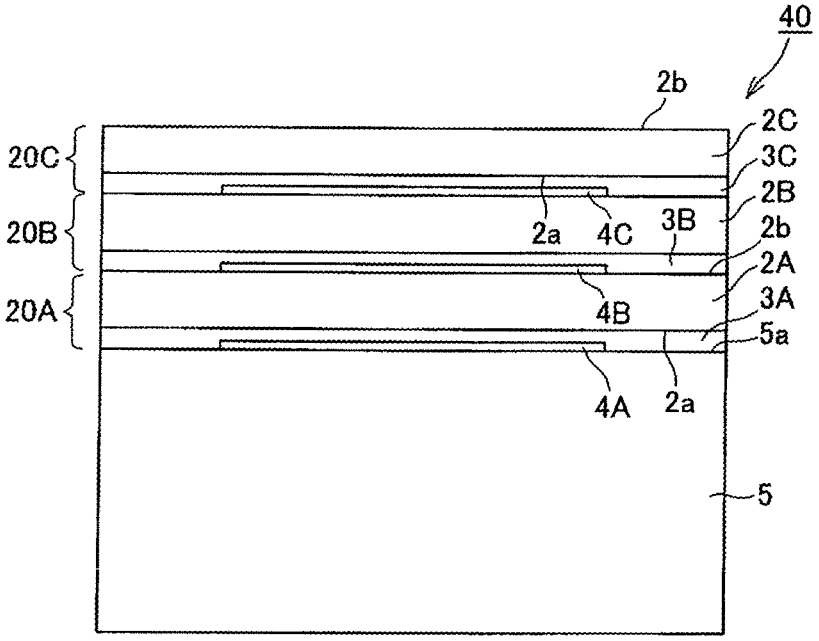
FIG. 6 is a diagram schematically showing a laminated ink recorded body 40 composed of the supporting body 5 and the ink recorded bodies 20A to 20C.
Figure 7:
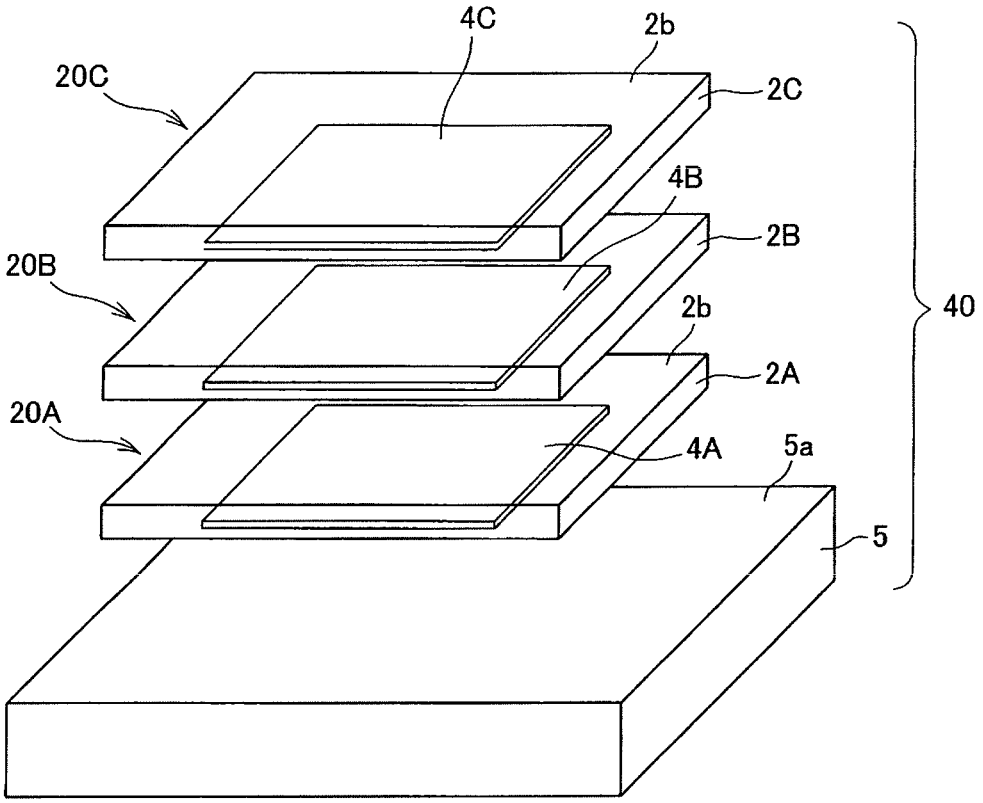
FIG. 7 is a broken perspective view schematic showing the laminated ink recorded body 40 of FIG. 6.

For example, according to an example of a laminated body 40 shown in FIGS. 5 to 7, ink recorded bodies 20A, 20B and 20C are laminated and joined with each other on a supporting body 5. Ink recording members 1A, 1B and 1C include substrates 2A, 2B, and 2C, respectively, films 3A, 3B and 3C made of the hydrophilic resin and formed on the main faces, respectively, and printed patterns 4A, 4B and 4C formed on the films, respectively. The films 3B and 3C and the substrates of the ink recorded bodies adjacent to each other in the direction of the lamination are joined with each other. The ink recorded body 20A laminated in the end is joined to a joining face 5*a* of the supporting body 5, and its film 3A and printed pattern 4 are sandwiched between the substrate 2A and supporting body 5.

Besides, in the laminated body, it is possible to sandwich a substrate without the film of the hydrophilic resin and printed pattern. Such design is decided depending on a target synthetic drawing pattern.

(Method of Joining Each of Ink Recorded Bodies and Supporting Body)

The method of joining the layers includes treatment with a drug, treatment with a solvent, monomer coating, treatment by irradiation of ultraviolet light, plasma contact treatment, and the method of utilizing the self-adhesiveness of the substrate.

(Preferred Embodiments of Method of Producing Ink Recorded Body)

The method of producing the ink recorded body includes complex processes such as adjustment of specific gravity of the substrate, covering with the hydrophilic resin and drawing of the ink pattern. Although mass production can be made by using a large scale production system, it is required a large amounts of raw materials, electric power and equipment costs for preparing a plurality of substrates according to different kinds of specifications, so that the costs of the ink recorded bodies become high.

As the method of alleviating the need of electric power and large scale equipment and of utilizing the raw materials without wasting them, in the complex production system, cast molding is listed. According to cast molding, it is possible to adjust the blending ratio and to attend various kinds of specifications depending on the production batches.

Specifically, it is included the step of dissolving a thermoplastic resin as the raw material and oil in an organic solvent, the step of drying the organic solvent in a mold, and the step of covering the hydrophilic resin onto the thus obtained substrate and then drawing the target ink pattern thereon. The substrate including the ink pattern may be further joined to another substrate, another ink recorded body and/or supporting body.

The concentration of the raw material dissolved in the organic solvents may preferably be 5 to 70 weight percent and more preferably be 20 to 50 weight percent, on the viewpoint of reducing the drying time of the organic solvent and obtaining good flowability into the mold at the same time.

In charging the raw material dissolved in the organic solvent into the mold, the temperature of the solution may preferably be higher than that of the mold by 5 to 15° C., for preventing the generation of bubbles in the substrate.

It is desirable to cover an upper part of the substrate by a cover while assuring the openings so as to prevent the direct contact of the solution with circulating air, for assuring flatness of the substrate.

EXAMPLES

Examples will be described below. Ink recorded bodies described in the Example section are taken as examples only, and the present invention is not limited to the examples.

(Method of Evaluating Adhesive Force of Substrate and Ink Fixing Film)

Figure 8:
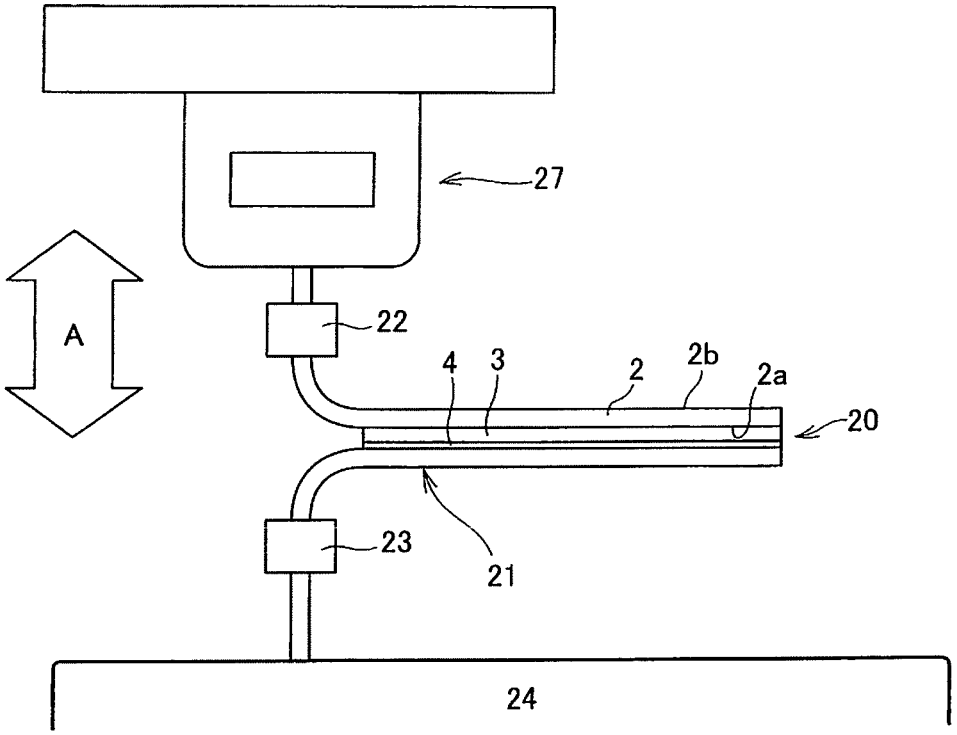
FIG. 8 is a diagram schematic showing a method of evaluating adhesive strength of a substrate and a pattern of printed ink.

As shown in FIG. 8, it was used a peeling test machine (type; FGP-1) supplied by NIDEC SIMPO CORPORATION to perform 180° peeling test. On an ink drawing surface 4 of produced ink recorded body 20, it was adhered a substrate 21 of an acrylic block copolymer supplied by KURARAY CO. LTD. having the function of self-adhesiveness (product name; CLARITY, product No. La2140e, width of 20 mm and thickness of 1 mm). The substrate 21 was held on a holder 23 fitted onto a fixing table 24, and a substrate 2 of an ink recorded body 20 was held on a holder 22 fitted to the peeling test machine 27, and it was pulled at an angle of 180° as an arrow A to measure an average strength at the time point of peeling (room temperature during the measurement was 23° C.).

(Method of Evaluating Adhesive Force of Substrate)

Figure 9:
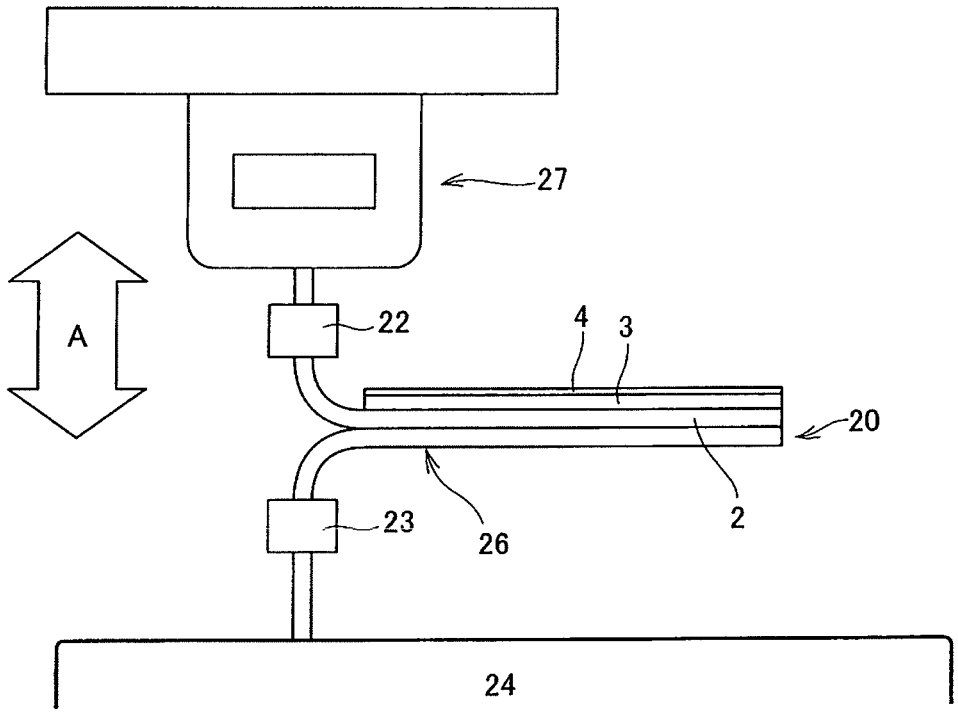
FIG. 9 is a diagram schematically showing a method of evaluating adhesive strength of a substrate to an outer body.
Figure 10:
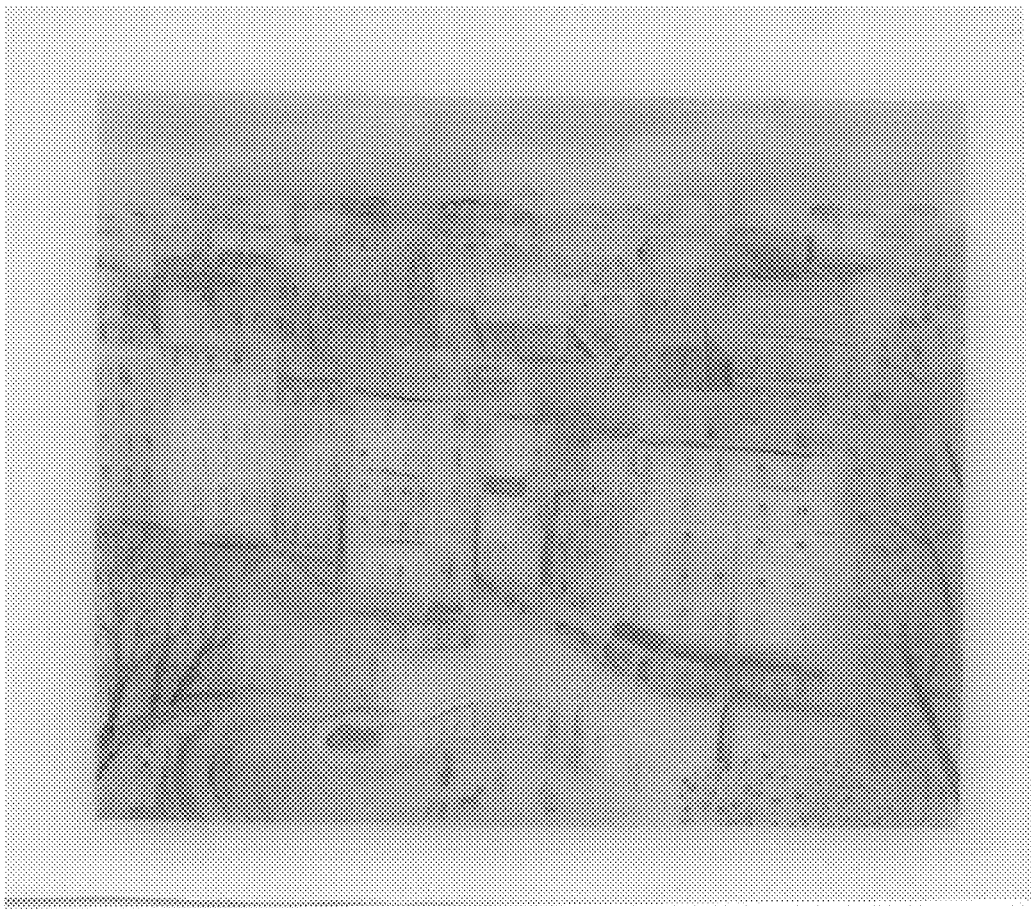
FIG. 10 is a photograph showing an example of a pattern of printed ink printed on an ink recording member.

As shown in FIG. 9, it was used a peeling test machine (type; FGP-1) supplied by NIDEC SIMPO CORPORATION to perform 180° peeling test. The substrate 2 of the thus produced ink recorded body 20 was adhered onto a PET substrate 26 having a thickness of 0.1 mm and width of 20 mm. The PET substrate 26 was held on the holder 23 fitted onto the fixing table 24, and the substrate 2 of the ink recorded body 20 was held on the holder 22 fitted to the peeling test machine 27. The ink recorded body 20 was pulled from the PET substrate 26 at an angle of 180° as an arrow A to measure an average strength at the time point of peeling (room temperature during the measurement was 23° C.).

(Measurement of Dynamic Viscoelasticity)

It was used an automated viscoelasticity measuring instrument "LEOVIBRON" (type; DDV) supplied by Orientec Co. Ltd. to measure the storage modulus (E') in a range of −100 to 200° C. and tan δ under the conditions of tension mode, at a temperature elevation rate of 3° C./minute and a frequency of 11 Hz.

(Shore Hardness (ASTM D-2240))

It was used a shore hardness tester (type; M durometer, IRHD-M) supplied by M & K Co. Ltd. to perform the measurement of shore hardness.

(Optical Properties)

It was used a meter of measuring visible light transmittance (type; HA-TR) supplied by SUGA TEST INSTRUMENTS CO. LTD. to measure total light transmittance and haze value. Specifically, the measurement was repeated twice according to the procedures of ISO13468 and ISO14782 to obtain the average value.

(Production of Ink Recorded Body of Comparative Example 1)

It was produced the substrate 2 as shown in FIG. 1. The film of the hydrophilic resin was not provided.

(Production of Substrate 2)

It was used mixture (polystyrene/castor oil=90/10 wt. %) of polystyrene (product name; general type, product No. GPPS) supplied by PS Japan corporation and castor oil (Ito Oil chemicals Co. Ltd., product name; purified castor oil, specific gravity; 0.95), which was dissolved into acetone at a concentration of 40 wt. %. Then, the temperature of the solution was elevated to 50° C. by a water bath, the solution was cast into a mold, and acetone was evaporated over 12 hours. A protective film (NIPPA CORPORATION, product name; silicone coat PET, product No. PET75×1-K0-ASI5) adhered onto a bottom face of the mold was removed from the mold to obtain the substrate 2 having vertical and horizontal sizes of 12 cm and a thickness of 1 mm.

(Production of Ink Recorded Body of Comparative Example 2)

The ink recorded body shown in FIGS. 2 and 3 was produced.

(Production of Substrate 2)

The substrate 2 was obtained according to the same procedure as the comparative example 1, except that it was used polymethyl methacrylate (product name; PARAPET, product No. GH-S) supplied by KURARAY Co. LTD.

(Covering of Substrate 2 with Film 3)

It was used water soluble resin (product name; polyvinyl alcohol, product No. PVA-505) supplied by KURARAY Co. Ltd., which was dissolved into pure water at a concentration of 4 wt. %. Then, four edges of the substrate 2 was fixed on a flat metal bat by a tape so as to prevent the impregnation of the solution into the bottom face of the substrate and warping of the substrate after drying polyvinyl alcohol.

Then, the solution of polyvinyl alcohol was dropped on the whole surface of the substrate, and the metal bat was inclined to discharge excessive solution. After water content was dried over 24 hours, the substrate was taken out from the metal bat to obtain the substrate 2 with the film 3 of the hydrophilic resin formed thereon.

The film thickness of polyvinyl alcohol was confirmed to be 0 to 28 microns by means of a micro meter (Mitutoyo Corporation, type MDE-MJ/PJ).

It was measured the contact angle with respect to water in air. It was obtained 24 to 75° by the measurement using a contact angle measuring system (supplied by Kyowa Interface Science Co. Ltd., CA-DT•A type).

(Drawing of Ink Pattern)

It was used an ink jet printer (CANON Corporation, product name; MG6130), and ink pattern was sent by a personal computer (PANASONIC Co. Ltd., product name; Let's Note; type; CF-S9) to perform the drawing. The substrate cut into vertical and horizontal sizes of 4.5 cm and 5.5 cm was fixed on a direct drawing tray of the ink jet printer to draw the ink pattern.

(Production of Ink Recorded Body of Comparative Example 3)

The ink recorded body shown in FIGS. 2 and 3 was produced.

That is, the body of the comparative example 3 was obtained according to the same procedure as the comparative example 2, except that the substrate was made of mixture (polymethyl methacrylate/olive oil=90/10 wt. %) of polymethyl methacrylate supplied by KULARAY Co. Ltd. (product name; PARAPET, product No.; GH-S) and olive oil (Kenei Pharmaceutical Co. Ltd., product name; olive oil P).

The film thickness of polyvinyl alcohol was 0 to 25 microns and the contact angle with respect to water was 22 to 74°.

(Production of Ink Recorded Body of Comparative Example 4)

The substrate 2 shown in FIG. 1 was produced. The film of the hydrophilic resin was not provided thereon.

The substrate 2 of the comparative example 4 was obtained according to the same procedure as the comparative example 1, except that it was used mixture (polymethyl methacrylate/castor oil=90/10 wt. %) of polymethyl methacrylate supplied by KULARAY Co. Ltd. (product name; PARAPET, product No.; GH-S) and castor oil (Ito Oil chemicals Co. Ltd., product name; purified castor oil). According to the comparative example 4, it was not provided the ink fixing film and the ink pattern was directly drawn onto the substrate.

(Production of Ink Recorded Body of Inventive Example 1)

The ink recorded body shown in FIGS. 2 and 3 was produced.

(Production of Substrate 2)

It was used mixture (acrylic block copolymer/castor oil=90/10 wt. %) of acrylic block copolymer supplied by KURARAY Co. Ltd. (product name; CLARITY, product No. La2140e, ABA type block copolymer) and castor oil (Ito Oil chemicals Co. Ltd., product name; purified castor oil). The mixture was dissolved into acetone in a concentration of 40 wt. %.

Then, the temperature of the solution was elevated to 50° C. by a water bath, the solution was cast into a mold, and acetone was evaporated over 12 hours. A protective film (NIPPA CORPORATION, product name; silicone coat PET, product No. PET75×1-K0-ASI5) adhered onto a bottom face of the mold was removed from the mold to obtain the substrate having vertical and horizontal sizes of 12 cm and a thickness of 1 mm.

(Covering of Substrate 2 with Film 3 of Hydrophilic Resin)

It was used water soluble resin (product name; polyvinyl alcohol, product No. PVA-505) supplied by KURARAY Co. Ltd., which was dissolved into pure water at a concentration of 2 wt. %. Then, four edges of the substrate was fixed on a flat metal bat by a tape so as to prevent the impregnation of the solution into the bottom face of the substrate and warping of the substrate after drying polyvinyl alcohol.

Then, the solution of polyvinyl alcohol was dropped on the whole surface of the substrate, and the metal bat was inclined to discharge excessive solution. After water content was dried over 24 hours, the substrate was taken out from the metal bat to obtain the substrate with the film of the hydrophilic resin formed thereon.

The film thickness of polyvinyl alcohol was confirmed to be 5 microns by means of a micro meter (Mitutoyo corporation, type MDE-MJ/PJ).

It was measured the contact angle with respect to water in air. It was obtained 25° by the measurement using a contact angle measuring system (supplied by Kyowa Interface science co. Ltd., CA-DT•A type). As to the optical properties, the total light transmittance and haze value were 89 percent and 5.5 percent, respectively.

(Drawing of Ink Pattern)

It was used an ink jet printer (CANON Corporation, product name; MG6130), and ink pattern was sent by a personal computer (PANASONIC Co. Ltd., product name; Let's Note; type; CF-S9) to perform the drawing. The substrate cut into vertical and horizontal sizes of 4.5 cm and 5.5 cm was fixed on a direct drawing tray of the ink jet printer to draw the ink pattern.

(Production of Ink Recorded Body of Inventive Example 2)

It was produced the ink recorded body having the shape shown in FIGS. 2 and 3.

However, the ink recorded body of the inventive example 2 was obtained according to the same procedure as the inventive example 1, except that the concentration of the water soluble resin supplied by KURARAY Co. Ltd. (polyvinyl alcohol, product No. PVA-505) was made 4 wt. %.

The film thickness of the polyvinyl alcohol film was 11 microns and the contact angle with respect to water was 24°. As to the optical properties, the total light transmittance and haze value were 88 percent and 7.0 percent, respectively.

(Production of Ink Recorded Body of Inventive Example 3)

It was produced the ink recorded body having the shape shown in FIGS. 2 to 4.

The body of the inventive example 3 was obtained according to the same procedure as the inventive example 1, except that the mixing ratio of acrylic block copolymer supplied by KURARAY Co. Ltd. (product name; CLARITY, product No. La2140e) and castor oil (Ito Oil chemicals Co. Ltd., product name; purified castor oil) was 95/5 wt. % (acrylic block copolymer/castor oil), and that the concentration of the water soluble resin supplied by KURARAY Co. Ltd. (product name; polyvinyl alcohol, product No. PVA-505) was 4 wt. %.

The film thickness of polyvinyl alcohol forming the ink fixing film was 10 microns and the contact angle with respect to water was 27°. As to the optical properties, the total light transmittance and haze value were 88 percent and 6.8 percent, respectively.

(Production of Ink Recorded Body of Inventive Example 4)

It was produced the ink recorded body having the shape shown in FIGS. 2 and 3.

The body of the inventive example 4 was obtained according to the same procedure as the inventive example 1, except that the mixing ratio of acrylic block copolymer supplied by KURARAY Co. Ltd. (product name; CLARITY, product No. La2140e) and castor oil (Ito Oil chemicals Co. Ltd., product name; purified castor oil) was 80/20 wt. % (acrylic block copolymer/castor oil), and that the concentration of the water soluble resin supplied by KURARAY Co. Ltd. (product name; polyvinyl alcohol, product No. PVA-505) was 4 wt. %.

The film thickness of the polyvinyl alcohol film was 10 microns and the contact angle with respect to water was 23°. As to the optical properties, the total light transmittance and haze value were 85 percent and 9.5 percent, respectively.

The constructions of the examples were shown in tables 1 and 2.

TABLE 1

| | | | Comparative Example 1 | Comparative Example 2 | Comparative Example 3 | Comparative Example 4 |
|---|---|---|---|---|---|---|
| Substrate | Resin | Name | Polystyrene | Polymethyl methacrylate | Polymethyl methacrylate | Polymethyl methacrylate |
| | | Added amount (wt %) | 90 | 100 | 90 | 90 |
| | oil | Name | Castor oil | — | Olive oil | Castor oil |
| | | Added amount (wt %) | 10 | — | 10 | 10 |
| Film fixing film | Hydrophilic resin | name | — | Polyvinyl alcohol | Polyvinyl alcohol | — |
| | | Contact angle to water (°) | — | 24~75 | 22~74 | — |
| | | Film thickness (micron) | | 0~28 | 0~25 | — |

TABLE 1-continued

| | | | Comparative Example 1 | Comparative Example 2 | Comparative Example 3 | Comparative Example 4 |
|---|---|---|---|---|---|---|
| Physical Properties | Mixed state of resin and oil | | x | — | ○ | ○ |
| | Ink fixing film | Sate of Coverage | — | x | x | — |
| | | Definition of drawing | — | x | x | x |
| | | Adhesive force (g) | — | — | — | — |
| | Dynamic viscoelasticity | Storage modulus (MPa) | — | — | — | — |
| | | tanδ (° C.) | — | — | — | — |
| | Shore hardness (ASTM D 2240) | | — | — | — | — |
| | Self-adhesiveness of substrate (g) | | — | — | — | — |
| | Optical properties (t 1 mm) | Total light transmittance (%) | — | — | — | — |
| | | Haze value (%) | — | — | — | — |

15

TABLE 2

| | | | Example 1 | Example 2 | Example 3 | Example 4 |
|---|---|---|---|---|---|---|
| Substrate | Resin | Name | Acrylic block copolymer | Acrylic block copolymer | Acrylic block copolymer | Acrylic block copolymer |
| | | Added amount (wt %) | 90 | 90 | 95 | 80 |
| | Oil | Name | Castor oil | Castor oil | Castor oil | Castor oil |
| | | Added amount (wt %) | 10 | 10 | 5 | 20 |
| Ink fixing film | Hydrophilic Resin | Name | Polyvinyl alcohol | Polyvinyl alcohol | Polyvinyl alcohol | Polyvinyl alcohol |
| | | Contact angle to water (°) | 25 | 24 | 27 | 23 |
| | | Film thickness (micron) | 5 | 11 | 10 | 10 |
| Physical Properties | Mixed state of resin and oil | | ○ | ○ | ○ | ○ |
| | ink fixing film | State of Coverage | ○ | ○ | ○ | ○ |
| | | Definition of drawing | ○ | ○ | ○ | ○ |
| | | Adhesive force (N) | 2.5 | 2.6 | 1.9 | 2.5 |
| | Visco-Elasticity | Storage modulus (MPa) | 0.5 | 0.5 | 0.5 | 0.5 |
| | | tanδ (° C.) | −25 | −25 | −25 | −25 |
| | Shore hardness (ASTM D 2240) | | 28 | 38 | 38 | 38 |
| | Self-adhesiveness Of substrate (N) | | 3.0 | 3.2 | 3.3 | 3.1 |
| | Optical properties (t 1 mm) | Total light transmittance (%) | 89 | 88 | 88 | 85 |
| | | Haze value (%) | 5.5 | 7.0 | 6.8 | 9.5 |

(Experimental Results)

According to the comparative example 1, polystyrene and castor oil were not dissolved with each other and castor oil was aggregated on the polystyrene substrate, so that it could not be obtained the substrate.

According to the comparative example 2 in which the substrate was composed of polymethyl methacrylate only and directly covered with polyvinyl alcohol forming the ink fixing film, due to the deviation of film thickness and contact angle to water, the hydrophilic polyvinyl alcohol was repelled by the hydrophobic polymethyl methacrylate and the substrate was not proved to be covered with the ink fixing film.

According to the comparative example 3 in which it was blended to polymethyl methacrylate olive oil including, as the main component, oleic acid having only carboxyl group as a functional group among fatty acids, polymethyl methacrylate and olive oil could be mixed. However, due to the deviation of film thickness and contact angle to water, the affinity to hydrophilic polyvinyl alcohol is low and it was proved that the substrate was not covered with the ink fixing film.

According to the comparative example 4 in which plant oil (castor oil) including fatty acid having hydroxyl and carboxyl groups was blended to polymethacrylate, the plant oil (castor oil) including fatty acid having hydroxyl and carboxyl group could be mixed with polymethyl methacrylate. However, since the ink fixing film was not provided, the ink was repelled and the drawing could not be performed.

According to the inventive examples 1 to 4, plant oil (castor oil) including fatty acid having hydroxyl and carboxyl groups was blended to the acrylic block copolymer as the acrylic resin, and as a result, it was proved that the acrylic block copolymer and castor oil were dissolved with each other at nano-order judging from the high transparency.

The coverage with the hydrophilic resin (polyvinyl alcohol) for the ink fixing film could be also attained judging from uniform film thickness and contact angle to water, by using the plant oil (castor oil) including fatty acid having hydroxyl and carboxyl groups. Further, based on the high adhesive strength between the substrate and ink fixing film, it was proved that the plant oil (castor oil) including fatty acid having hydroxyl and carboxyl groups and hydrophilic resin showed chemical affinity with each other.

According to the inventive example 1, compared with the other examples, it was proved that the substrate was uniformly covered with the ink fixing film even when the film thickness of the ink fixing film was as thin as 5 microns.

According to the inventive examples 3 and 4, compared with the other examples, it was proved that the substrate was uniformly covered with the ink fixing film even when the blending ratio of the plant oil (castor oil) including fatty acid having hydroxyl and carboxyl groups is low.

(Example of Drawing Ink)

Photograph of a picture of a size of No. 8 owned by the inventor (Montmartre Hill, drawn by Yujuro OZAWA, vertical size of 37.9 cm and horizontal size of 45.5 cm) was contracted by means of a personal computer (PANASONIC Co. Ltd., product name; Let's Note; type; CF-S9) and then printed on the ink recording member having a vertical size of 4.5 cm and horizontal size of 5.5 cm using an ink jet printer (CANON Corporation, Product Name; MG8130). However, it was used the ink recording member of the inventive example 2.

Inventive Example 5

The ink recorded body schematically shown in FIGS. 2 to 4 was produced according to the following procedure.

(Production of Substrate 2 Made of a Thermoplastic Resin)

It was used the substrate composed of mixture (acrylic block copolymer/castor oil=90/10 wt. %) of the acrylic block copolymer supplied by KURARAY Co. Ltd. (product name; CLARITY, product No. La2140e, specific gravity; 1.06) and castor oil (Ito Oil Chemicals Co. Ltd., product name; purified castor oil, specific gravity; 0.95). The concentration of polyvinyl alcohol as the water soluble resin was 4 wt. %. As to the optical properties of the substrate 2, the total light transmittance and haze value were 90 percent and 3.8 percent, respectively. It was proved that the contact angle of polyvinyl alcohol with respect to water was 18° and the film thickness was 8 microns.

(Covering of Substrate 2 with Hydrophilic Resin 3)

It was used water soluble resin (product name; polyvinyl alcohol, product No. PVA-505) supplied by KURARAY Co. Ltd., which was dissolved into pure water at a concentration of 8 wt. %. Then, four edges of the substrate was fixed on a flat metal bat by a tape so as to prevent the impregnation of the solution into the bottom face of the substrate and warping of the substrate after drying polyvinyl alcohol.

Then, the solution of polyvinyl alcohol was dropped on the whole surface of the substrate, and the metal bat was inclined to discharge excessive solution. After water content was dried over 24 hours, the substrate was taken out from the metal bat to obtain the substrate with the film of the hydrophilic resin formed thereon.

The film thickness of polyvinyl alcohol was confirmed to be 20 microns by means of a micro meter (Mitutoyo Corporation, type MDE-MJ/PJ).

It was measured the contact angle with respect to water in air. It was obtained 38° by the measurement using a contact angle measuring system (supplied by Kyowa Interface science co. Ltd., CA-DT•A type).

(Drawing of Ink Pattern 4)

It was used an ink jet printer (CANON Corporation, product name; MG6130), and ink pattern was sent by a personal computer (PANASONIC Co. Ltd., product name; Let's Note; type; CF-S9) to perform the drawing. The substrate cut into vertical and horizontal sizes of 4.5 cm and 5.5 cm was fixed on a direct drawing tray of the ink jet printer to draw ink pattern having desired colors and patterns. It took about 10 seconds per one substrate for the drawing of the ink pattern, and it was not observed drying defects of ink even in the case that the ink direct after the drawing was contacted.

(Joining with Supporting Body 5)

The self-adhesiveness of the acrylic block copolymer was utilized and the substrates were laminated to one another to perform the joining of the supporting body 5.

It was used the supporting body 5 having a thickness of 5 mm and made of an acrylic block copolymer having a specific gravity of 1.10. After the supporting body was joined, the end face was adhered with acetone for preventing the peeling from the end face. At the time of joining the lower layer, for preventing the inclusion of bubbles into the joining face, it is desirable that a scraper of a resin is used and applied a constant pressure from the end face of the substrate toward the opposite side during the joining process, for example.

Figure 11:
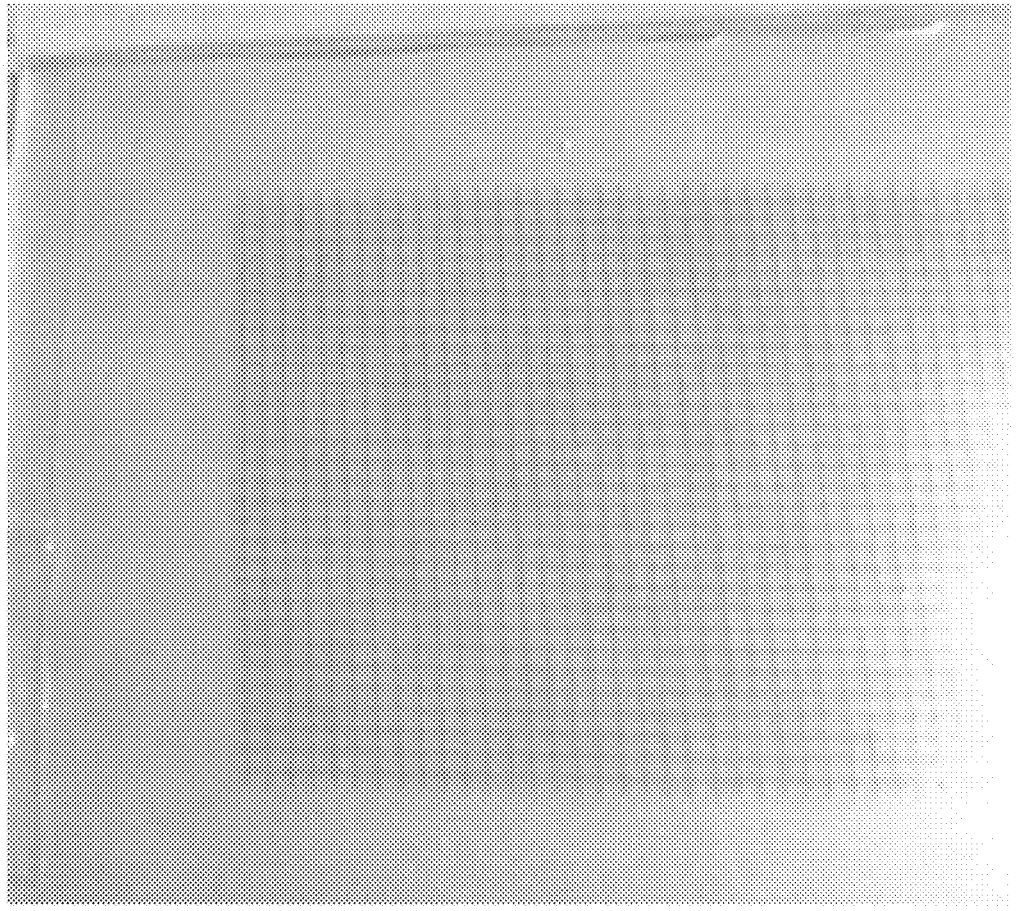
FIG. 11 is a photograph showing a drawing pattern of red ink drawn on the ink recording member of example 5.

FIG. 11 shows the drawn state. FIG. 11 is a photograph showing the drawing obtained by drawing red ink pattern on the substrate made of mixture of the acrylic block copolymer and castor oil according to the inventive example 5. Fine colored pattern was successfully and clearly fixed thereon.

Inventive Example 6

It was produced a laminated ink recorded body 40 described referring to FIGS. 5 to 7.

The procedures of the production of the ink recorded bodies 20A to 20C and supporting body 5 were same as those in the inventive example 1. However, each of the substrates 2A, 2B and 2C was produced by mixture (acrylic block copolymer/castor oil=90/10 wt. %) of acrylic block copolymer supplied by KURARAY Co. Ltd. (product name; CLARITY, product No. La2140e, specific gravity; 1.06) and castor oil (Ito Oil chemicals Co. Ltd., product name; purified castor oil, specific gravity; 0.95). The concentration of polyvinyl alcohol, the water soluble resin, was 4 wt. %. As to the optical properties, the total light transmittance and haze value were 90 percent and 3.5 percent, respectively. The contact angle with respect to water was 21°, and the film thickness was 10 microns.

Inventive Example 7

The laminated ink recorded body was produced according to the same procedure as the inventive example 6. However, the layered structure was composed of three layers, and the ink pattern was recorded in the first layer with respect to the supporting body. Ink pattern was not provided in the second and third ink recording layers.

Inventive Example 8

A laminated ink recorded body was produced according to the same procedure as the inventive example 6. However, the layered structure was composed of three layers, and the ink patterns were recorded in the first and second layers with respect to the supporting body, respectively. Ink pattern was not provided in the third ink recording layer.

Here, table 3 shows summary of the inventive examples 6 to 8. In each of the laminated ink recorded bodies, fine colored pattern could be successfully and clearly fixed thereon.

TABLE 3

| | | | Example 6 | Example 7 | Example 8 |
|---|---|---|---|---|---|
| Sheet | Thermoplastic resin | Name | Acrylic block copolymer | Acrylic block copolymer | Acrylic block copolymer |
| | | Added amount (wt %) | 90 | 90 | 90 |

TABLE 3-continued

| | | | | Example 6 | Example 7 | Example 8 |
|---|---|---|---|---|---|---|
| | Oil | | Name | Castor oil | Castor oil | Castor oil |
| | | | Added amount (wt %) | 10 | 10 | 10 |
| Hydrophilic resin | Polyvinyl alcohol | | Contact angle to Water (°) | 21 | 17 | 20 |
| | | | Film thickness (micron) | 10 | 9 | 10 |
| Number of layers | | | | | | |
| Layer structure | First Layer | Optical Properties (t 1 mm) | Total light transmittance (%) | 90 | 90 | 90 |
| | | | Haze value (%) | 3.5 | 3.5 | 3.5 |
| | | Color of ink | | Red | Red | Red |
| | Second Layer | Optical properties (t 1 mm) | Total light transmittance (%) | 90 | — | 90 |
| | | | ヘイズ (%) | 3.5 | — | 3.5 |
| | | Color of ink | | Red | — | Red |
| | Third layer | Optical properties (t 1 mm) | Total light transmittance (%) | 90 | — | — |
| | | | Haze value (%) | 3.5 | — | — |
| | | Color of ink | | Red | — | — |

Inventive Example A1

The ink recorded body was produced according to the same procedure as the inventive example 1 described above.

However, different form the inventive example 1, it was used water soluble resin supplied by KURARAY Co. Ltd. (product name; polyvinyl alcohol, product No. PVA-217 (molecular weight 1700)) as the water soluble resin forming the ink fixing film, and the film thickness of the ink fixing film was made 11 microns.

As a result, good drawing could be made as the inventive example 1.

Example A2

The ink recorded body was produced according to the same procedure as the inventive example 2 described above.

However, different form the inventive example 2, it was used water soluble resin supplied by KURARAY Co. Ltd. (product name; polyvinyl alcohol, product No. PVA-217 (molecular weight 1700)) as the water soluble resin forming the ink fixing film, and the film thickness of the ink fixing film was made 20 microns.

As a result, good drawing could be made as the inventive example 2.

Example A3

The ink recorded body was produced according to the same procedure as the inventive example 3 described above.

However, different form the inventive example 3, it was used water soluble resin supplied by KURARAY Co. Ltd. (product name; polyvinyl alcohol, product No. PVA-217 (molecular weight 1700)) as the water soluble resin forming the ink fixing film, and the film thickness of the ink fixing film was made 22 microns.

As a result, good drawing could be made as the inventive example 3.

Example A4

The ink recorded body was produced according to the same procedure as the inventive example 4 described above.

However, different form the inventive example 4, it was used water soluble resin supplied by KURARAY Co. Ltd. (product name; polyvinyl alcohol, product No. PVA-217 (molecular weight 1700)) as the water soluble resin forming the ink fixing film, and the film thickness of the ink fixing film was made 18 microns.

As a result, good drawing could be made as the inventive example 4.

Example A5

The ink recorded body was produced according to the same procedure as the inventive example 5 described above.

However, different form the inventive example 5, the thickness of polyvinyl alcohol in the substrate 2 was 20 microns, it was used water soluble resin supplied by KURARAY Co. Ltd. (product name; polyvinyl alcohol, product No. PVA-217 (molecular weight 1700)) as the hydrophilic resin 3 covering the substrate 2, and the film thickness of the hydrophilic resin film was made 42 microns.

As a result, good drawing could be made as the inventive example 5.

Example A6

The ink recorded body was produced according to the same procedure as the inventive example 6 described above.

However, different form the inventive example 6, it was used water soluble resin supplied by KURARAY Co. Ltd. (product name; polyvinyl alcohol, product No. PVA-217 (molecular weight 1700)) as the water soluble resin forming the ink fixing film, and the film thickness of the ink fixing film was made 20 microns.

As a result, good drawing could be made as the inventive example 6.

The invention claimed is:

1. An ink recording member comprising:

a substrate comprising an acrylic resin and a plant oil blended to said acrylic resin, said plant oil being derived from a fatty acid having hydroxyl group and carboxyl group; and a ink fixing film provided on an at least one main face of said substrate and comprising a hydrophilic resin.

2. The ink recording member of claim 1, wherein said acrylic resin comprises an acrylic block copolymer.

3. The ink recording member of claim 1, wherein said plant oil comprises castor oil or a derivative thereof.

4. The ink recording member of claim 1, wherein an adhesive strength between said substrate and said ink fixing film is 0.3 to 10 N.

5. The ink recording member of claim 1, wherein a storage modulus (E') at a temperature of 10° C. to 40° C.±3 is 10000 Pa to 100 MPa, in a measurement of dynamic viscoelasticity (tension mode, 11 Hz) of said substrate.

6. The ink recording member of claim 1, wherein a peak temperature of tan δ of a soft segment corresponding to transition from glass state to rubber state is in a range of −80° C. to +50° C., in a measurement of dynamic viscoelasticity (tension mode, 11 Hz) of said substrate.

7. The ink recording member of claim 1, wherein said substrate has a shore hardness (ASTM D2240) in a range of 10 to 90 at a temperature of 10° C. to 40° C.

8. The ink recording member of claim 1, wherein said substrate has a self-adhesiveness of 0.5 to 10 N.

9. The ink recording member of claim 1, wherein said hydrophilic resin comprises a water soluble resin.

10. The ink recording member of claim 1, wherein said hydrophilic resin has a contact angle with respect to water of 3° to 60°.

11. The ink recording member of claim 1, having a total light transmittance of 70 percent or higher and a haze value of 30 percent or lower.

12. The ink recording member of claim 1, further comprising a supporting body joined with said substrate.

13. An ink recorded body, comprising said ink recording member of claim 1, and an ink printed pattern fixed on said ink fixing film.

14. The ink recorded body of claim 13, wherein said ink comprises at least one of a water soluble pigment ink and a water soluble dye ink.

15. A laminated ink recorded body comprising a plurality of said ink recorded bodies of claim 13, wherein said ink recorded bodies are laminated.

* * * * *